United States Patent [19]

Jacob

[11] Patent Number: 4,847,942

[45] Date of Patent: Jul. 18, 1989

[54] ARRANGEMENT FOR SWITCHING ON AND OFF OF A VACUUM CLEANER

[75] Inventor: Gernot Jacob, Weissach, Fed. Rep. of Germany

[73] Assignee: Progress-Elektrogeraete & Pfeiffer GmbH & Co., Nuertingen, Fed. Rep. of Germany

[21] Appl. No.: 233,903

[22] Filed: Aug. 17, 1988

Related U.S. Application Data

[63] Continuation of Ser. No. 889,340, Jul. 25, 1986, abandoned.

[30] Foreign Application Priority Data

Aug. 28, 1985 [DE] Fed. Rep. of Germany ..... 3530784

[51] Int. Cl.[4] ..... A47L 5/00

[52] U.S. Cl. ..... 15/339; 15/412

[58] Field of Search ..... 15/339, 412; 200/292, 200/340

[56] References Cited

U.S. PATENT DOCUMENTS

| | | | |
|---|---|---|---|
| 3,872,539 | 3/1975 | Doyel | 15/412 |
| 4,136,270 | 1/1979 | Wernet et al. | 200/340 |
| 4,355,483 | 10/1982 | Korzelius | 200/292 |
| 4,631,377 | 12/1986 | Imazeki et al. | 200/340 |

FOREIGN PATENT DOCUMENTS

| | | | |
|---|---|---|---|
| 2403983 | 8/1975 | Fed. Rep. of Germany | 200/340 |

*Primary Examiner*—Philip R. Coe
*Assistant Examiner*—Corinne M. Reinckens
*Attorney, Agent, or Firm*—Birch, Stewart, Kolasch & Birch

[57] ABSTRACT

The arrangement for switching on and off of a vacuum cleaner comprises a switch which is integrated in a printed circuit board disposed below the cover of the vacuum cleaner housing. In the cover there is formed a resilient tongue having an upwardly projecting handle portion so that a bowl-shaped cavity is created in the free end of the resilient tongue. The switch extends into said bowl-shaped cavity and is operated by means of the resilient tongue. The production and mounting of the arrangement for switching on and off of the vacuum cleaner require only low expenditure of labor.

9 Claims, 2 Drawing Sheets

ARRANGEMENT FOR SWITCHING ON AND OFF OF A VACUUM CLEANER

This application is a continuation of application Ser. No. 06/889,340 filed on July 25, 1986, now abandoned.

BACKGROUND OF THE INVENTION

1. Field of the Invention

The invention relates to an arrangement for switching on and off of a vacuum cleaner, which has a housing having a cover, and which further has a switch.

2. Description of Background Art

In the hitherto known vacuum cleaners the switch for switching the vacuum cleaner on and off is arranged on the vacuum cleaner housing, where it may directly be operated by an operating person. For this purpose a borehole is provided at a defined place of the housing of the vacuum cleaner, in which borehole the switch is fastened by particular fastening means. Then the switch fastened on the vacuum cleaner housing is connected to the pertinent electric lines so that the switch is operable.

Such known arrangement for switching on and off of a vacuum cleaner causes relatively high expenses as it requires a considerable expenditure of labor to provide the boreholes, fittings and the like for the switch, to fasten the switch to the housing and then to provide the connection. Further, the switch, which is exposed on the outside, may be damaged due to improper handling. Besides that, a switch disposed in the known manner on the vacuum cleaner housing generally impairs the outward appearance of the vacuum cleaner.

SUMMARY AND OBJECTS OF THE INVENTION

It is the object of the invention to improve an arrangement for switching on and off a vacuum cleaner in a way which requires less expenditure of labor for producing and mounting, so that on the whole the costs of production of such a vacuum cleaner may be considerably reduced. Further, the vacuum cleaner with its arrangement for switching on and off is to meet increased esthetical requirements.

The object of the invention is achieved by an arrangement wherein the switch is integrated in a printed circuit board disposed below the cover of the vacuum cleaner housing, and wherein the switch is operable by means of a resilient tongue in the cover.

According to the invention there is arranged a printed circuit board below the cover of the vacuum cleaner housing, in which printed circuit board there is integrated the switch for switching the apparatus on and off. This switch is operated by means of a resilient tongue in the cover from the outside of the vacuum cleaner housing. In such an arrangement the switch is premounted on the printed circuit board so that said board may be mounted as an integral constructional unit. Thereby it is no longer necessary to fasten the switch in a separate and time-consuming working step at a certain place of the vacuum cleaner housing. Further, there is no more need to connect the switch, which was previously mounted, with the pertinent electric lines.

Thus, the production and mounting of the arrangement according to the invention require only extremely low expenditure of work, whereby the total costs of production of the vacuum cleaner may be reduced.

The switch, which is disposed below the cover of the vacuum cleaner housing, is safely protected from being damaged due to improper handling. Since furthermore the switch is arranged in a manner that it is not visible on the outside, the whole outward appearance of the vacuum cleaner housing is very pleasing.

Preferably the cover and the resilient tongue are made in one piece so as to meet the requirements of low costs of production of the components of the vacuum cleaner. In a plan view to the cover, the resilient tongue is suitably made as a substantially U-shaped slot which is cut in the cover wall. Preferably the slot is made in a mold by two staggered dies. This provides for a particular narrow design of the slot between the resilient tongue and the remaining cover, so that the space with the printed circuit board lying below the cover is largely protected from penetrating dust particles. Despite the particularly narrow design of the slot such a manufacturing method ensures that the resilient tongue may move completely freely, because the formation of ridges impeding the mobility in the area of the slot may reliably be avoided.

In the area of the slot the cover is provided with a circumferential reinforcing rib extending in the direction of the printed circuit board. Said reinforcing rib prevents the cover from being undesirably deformed in the edge section adjacent to the resilient tongue.

According to another advantageous proposal of the invention the tongue has an upwardly projecting handle portion in the area of its free end, and the switch extends into the thus formed bowl-shaped cavity of the handle portion. The tongue may be operated particularly easily and safely by its projecting handle portion, because this handle portion may be clearly seen and also felt. The switch need not be disposed on an exactly defined place of the printed circuit board; it will be completely sufficient to arrange it in a way that it engages with the bowl-shaped cavity of the handle portion.

On its surface which is substantially horizontal when being in the normal position, the handle portion is suitably corrugated.

Further it is expedient to have only a minor spacing between the top of the switch and the bottom side of the handle portion when the latter is in the normal position. In this case, for operating the switch the tongue need be pressed down only by a short distance.

BRIEF DESCRIPTION OF THE DRAWINGS

Further features, advantages and details of the invention will become apparent from the following description of a preferred embodiment as well as with reference to the drawings, in which.

DETAILED DESCRIPTION OF PREFERRED EMBODIMENT

The cover 1 of a vacuum cleaner housing 2 comprises for operating of a switch 3 a resilient tongue 4 which is formed by a substantially U-shaped slot in the cover wall.

Figure 1:
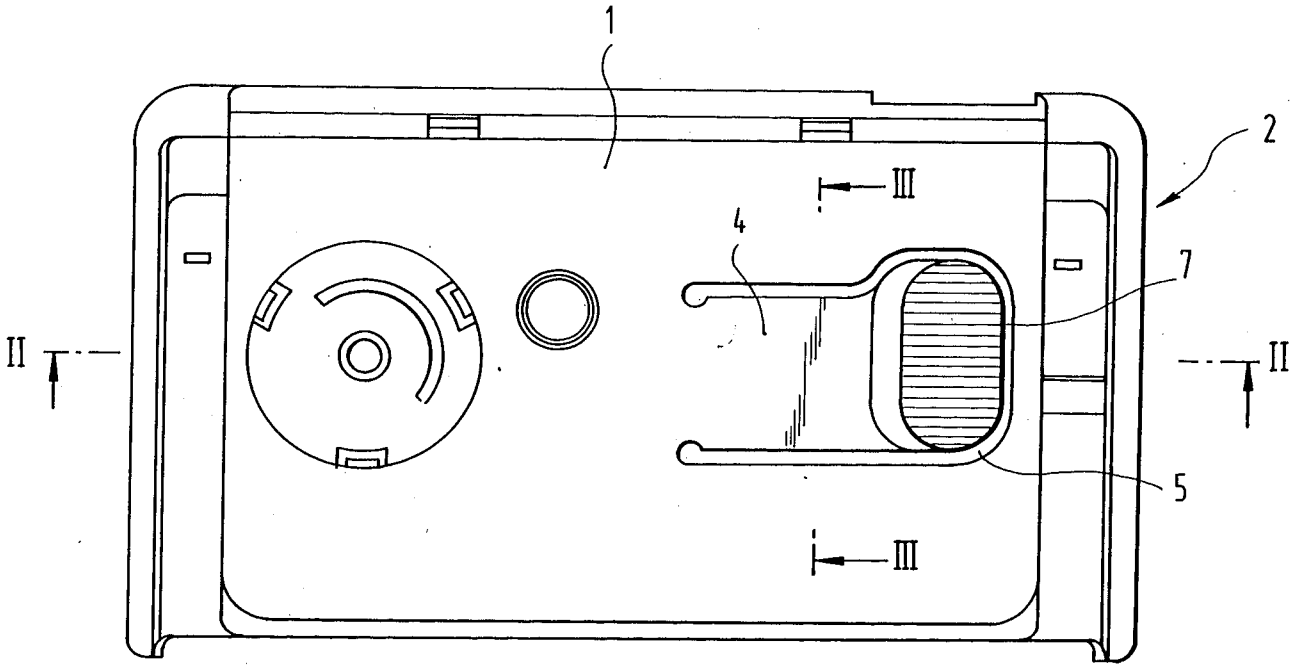
FIG. 1 is a top view to a housing cover including a resilient tongue for operating a switch.
Figure 2:
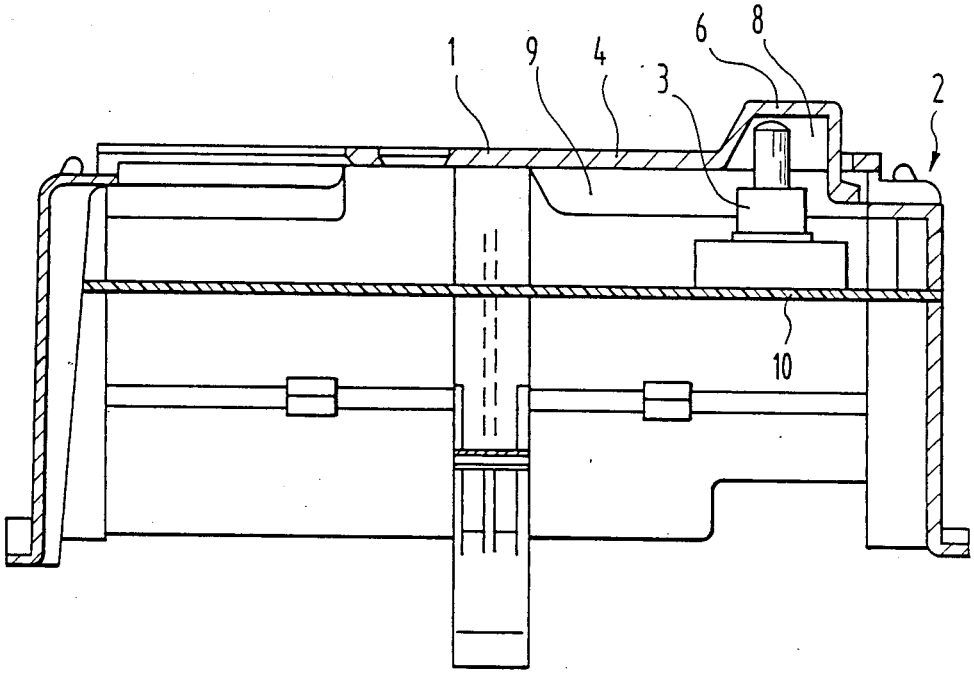
FIG. 2 is a section along the line II—II in FIG. 1.

As particularly to be seen from FIG. 2, the resilient tongue 4 at its fill end has an upwardly projecting handle portion 6 extending generally parallel to the cover wall when the resilient tongue 4 is in a normal undisplaced position. The handle portion 6 has corrugations 7.

Due to the upwardly projecting handle portion 6 there is formed a bowl-shaped cavity 8 in the area of the free end of the resilient tongue 4, and the top of the switch 3 extends into said cavity in a manner that it is only to a minor extent spaced from the bottom side of the handle portion 6 when the latter is in the normal position.

In the area adjoining the slot 5 the cover 1 has a circumferential reinforcing rib 9 providing the cover 1 with the required stability in the area of the resilient tongue 4.

The switch 3 is integrated in a printed circuit board 10, which is arranged at a distance below the cover 1 such that the top of the switch 3 extends into the bowl-shaped cavity 8 at a minor distance from the bottom side of the handle portion 6. As to be seen in FIG. 2, the switch 3 need not be placed upon an exactly defined place of the printed circuit board 10, but the arrangement must be made in a manner that the top of the switch 3 is within the bowl-shaped cavity 8.

Figure 3:
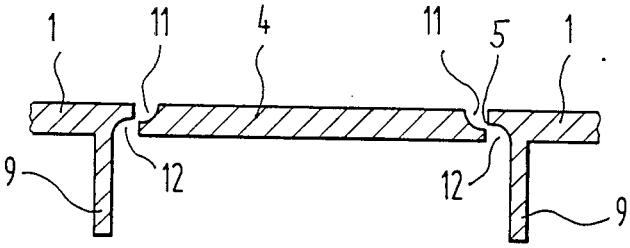
FIG. 3 is a section along the line III—III in FIG. 1 in an enlarged scale.

As particularly to be seen from FIG. 3, the slot 5 is made particularly narrow so as to largely prevent dust from penetrating into the space lying below the cover. The submerged slot 5 is made in a mold by two staggered dies which are so arranged that on casting there will be created the recesses 11 and 12. Though the thus created submerged slot 5 is very narrow, the resilient tongue 4 may move freely, since due to the casting by two staggered dies, the formation of projecting ridges can be safely avoided.

I claim:

1. A cover for a switch member for turning on and off a vacuum cleaner comprising:

a housing for said vacuum cleaner, said housing including a cover member for providing a closure to a predetermined portion of said vacuum cleaner;

a switch integrated in a printed circuit board and being disposed within said housing and at a predetermined distance below said cover member; and a resilient tongue member integrally formed in said cover member and being one piece together with said cover member;

said resilient tongue member being selectively displaceable relative to said cover member for engaging said switch to turn said switch on and off.

2. A cover for a switch according to claim 1 wherein said resilient tongue is defined by a substantially U-shaped slot in the cover member.

3. A cover for a switch according to claim 2, wherein the slot is submerged and made in a mold by two staggered dies.

4. A cover for a switch according to claim 2, wherein in the area of the slot the cover member is provided with a circumferential reinforcing rib extending in the direction of the printed circuit board.

5. A cover for a switch according to claim 1, wherein the resilient tongue member is integrally joined at one end to said cover member and has a free end distal to said one end, said tongue member also having an upwardly projecting handle portion with a bowl-shaped cavity in the area of said free end, said switch extending into said bowl-shaped cavity.

6. A cover for a switch according to claim 5, wherein a surface of said handle portion is substantially parallel to said cover member when said tongue member is in an undisplaced position, said surface being corrugated.

7. A cover for a switch according to claim 5, characterized in that there is only a minor spacing between the switch and a downwardly facing surface of the handle portion when the tongue member is in an undisplaced position.

8. A cover for a switch according to claim 1, characterized in that the switch is located upon an upper surface of the printed circuit board.

9. An arrangement for turning on and off a vacuum cleaner comprising:

a housing member for said vacuum cleaner, said housing member having a planar surface portion;

a switch provided at a position spaced below said planar surface portion of said housing member, said switch being operable for turning on and off said vacuum cleaner;

a printed circuit board electrically connected with said switch, wherein said printed circuit board is responsive to an on and off actuation of said switch to power said vacuum cleaner; and means for actuating said switch through said housing member, said means for actuating including a resilient tongue formed in the planar surface portion of said housing member and spaced a predetermined distance from said switch, whereby a depression of said resilient tongue below the planar surface portion of said vacuum cleaner housing will effectuate contact of said tongue with said switch to turn said vacuum cleaner on or off.

* * * * *